United States Patent [19]

Liliano

[11] Patent Number: 4,585,114

[45] Date of Patent: Apr. 29, 1986

[54] APPARATUS FOR THE LATERAL TRANSFER OF MANDRELS IN A TUBE ROLLING MILL

[75] Inventor: Bassi Liliano, Milan, Italy

[73] Assignee: Innse-Innocenti Santeustacchio S.p.A., Brescia, Italy

[21] Appl. No.: 661,296

[22] Filed: Oct. 15, 1984

[30] Foreign Application Priority Data

Oct. 28, 1983 [IT] Italy ..... 23521 A/83

[51] Int. Cl.[4] ..... B65G 37/00

[52] U.S. Cl. ..... 198/570; 198/614; 198/774; 72/96; 72/150; 72/208; 72/424

[58] Field of Search ..... 72/96, 150, 208, 97, 72/250, 252, 257, 424, 209, 426; 414/745, 748; 198/774, 570, 614

[56] References Cited

U.S. PATENT DOCUMENTS

| | | | |
|---|---|---|---|
| 2,024,514 | 12/1935 | Diescher | 72/208 |
| 3,419,159 | 12/1968 | Schaller et al. | 414/748 |
| 4,512,280 | 4/1985 | Lee, Jr. | 198/774 |

*Primary Examiner*—Francis S. Husar
*Assistant Examiner*—Robert Showalter
*Attorney, Agent, or Firm*—Fleit, Jacobson, Cohn & Price

[57] ABSTRACT

Apparatus for the transfer of mandrels from a lube conveyor to a parallel mandrel pre-insertion line comprises a plurality of transfer devices each of which has an arm for the direct transfer of the mandrels which is disappearingly movable transversely between the said conveyor and the said line and a further pair of arms, one fixed and one movable, having upper saw-tooth profiles cooperating to effect a stepwise displacement of the mandrels between the said conveyor and the said line.

4 Claims, 7 Drawing Figures

APPARATUS FOR THE LATERAL TRANSFER OF MANDRELS IN A TUBE ROLLING MILL

BACKGROUND OF THE INVENTION

The present invention relates to apparatus for the lateral transfer of rod-like mandrels in a tube rolling mill.

More particularly, the invention is concerned with apparatus for the transfer of mandrels from the exit of a roller track of a mandrel lubrication station to a roller track of a station for the pre-insertion of the mandrels in respective axially pierced hot intermediate forgings to be conveyed to the tube rolling mill.

At the exit of a tube rolling mill of the type considered, the mandrels are extracted from the respective rolled tubes and are subjected to a whole series of treatments before being used in a new rolling cycle. These treatments are carried out in a series of appropriate stations, generally located upstream of the rolling mill. The last of these stations is a lube station from which the lubricated mandrels are taken by a roller track extending laterally of the rolling mill and parallel to the rolling axis. In the following description and in the subsequent claims, this roller track will be termed "the lube conveyor".

Before entering the rolling mill, the lubricated mandrels are pre-inserted in respective intermediate forgings at an appropriate pre-insertion station, at the entry to which each mandrel is supported by a roller track which may be in line with the rolling mill or may extend laterally thereof parallel to the rolling axis. In the following description and in the subsequent claims, this roller track will be termed: the pre-insertion line.

A transfer device provides for the transfer of the lubricated mandrels from the lube conveyor directly to the pre-insertion line.

It is known that, in order to make the best use of the capacity of a rolling mill of the type considered during a rolling cycle in which a mandrel is directly engaged, another three to five mandrels are distributed between the various treatment stations in a so-called "mandrel circulation". The number of mandrels and the times for treatment and transfer from one station to the other are calculated so that a lubricated mandrel is ready at the pre-insertion station when a rolled tube leaves the rolling mill.

In the present method of operation, in the event of accidental stoppage of the rolling mill, it is necessary to stop the mandrel circulation upstream of the rolling mill. This involves well known disadvantages both of a technical nature and of a strictly economic nature. For example, a more or less prolonged stoppage of the mandrels before the lubrication station may cause their temperatures to drop to values such that the lubricant does not adhere to them very well.

Consequently, the considerable forces to which the mandrels are subject during rolling may cause a noticeable reduction in the useful life of the mandrels.

The problem at the root of the present invention is that of overcoming the said disadvantages by providing apparatus having structural and functional characteristics such that it allows the treatments for the restoration of the mandrels for use in the rolling mill to be completed even in the event of an accidental stoppage of the rolling mill itself.

SUMMARY OF THE INVENTION

This problem is solved according to the invention by means of an apparatus for the lateral transfer of mandrels in a tube rolling mill, particularly for the transfer of mandrels from a lube conveyor to an adjacent, parallel pre-insertion line, including at least two transfer devices, characterised in that each of the transfer devices comprises:

a fixed arm extending transversely between the lube conveyor and the pre-insertion line and having an upper substantially saw-tooth profile with the front facing the lube conveyor, a first tooth having its front preceded by a back extending close to the lube conveyor at a level above the upper profile thereof, the final tooth having its back descending towards the pre-insertion line and terminating near it, a first arm movable in a vertical plane perpendicular to the lube conveyor and the pre-insertion line, which arm extends between the conveyor and the line and has one end outside the lube conveyor, the first movable arm having an upper saw-tooth profile substantially the same as that of the fixed arm but staggered relative thereto towards the lube conveyor, a first tooth having a front preceded by a back extending across the lube conveyor, drive means for moving the first movable arm between first and second positions in which the respective teeth have their backs at a lower level and an upper level respectively compared to the backs of the teeth of the fixed arm, a second arm movable in a vertical plane perpendicular to the lube conveyor and the pre-insertion line, which arm extends between the conveyor and the line and has an upper straight profile and one end outside the lube conveyor, drive means for moving the second movable arm between first and second positions in which the upper straight profile thereof is respectively entirely beneath and above the teeth of the fixed arm in the second position, the straight profile of the second movable arm being inclined downwardly and towards the pre-insertion line.

According to a further characteristic of the invention, the movable arms have respective ends outside the lube conveyor mounted coaxially on a horizontal shaft supported parallel to the lube conveyor.

Further characteristics and advantages of the invention will become more apparent from the description of one embodiment thereof made below with reference to the appended drawings, given purely by way of non-limiting example, in which:

DETAILED DESCRIPTION

Figure 1:
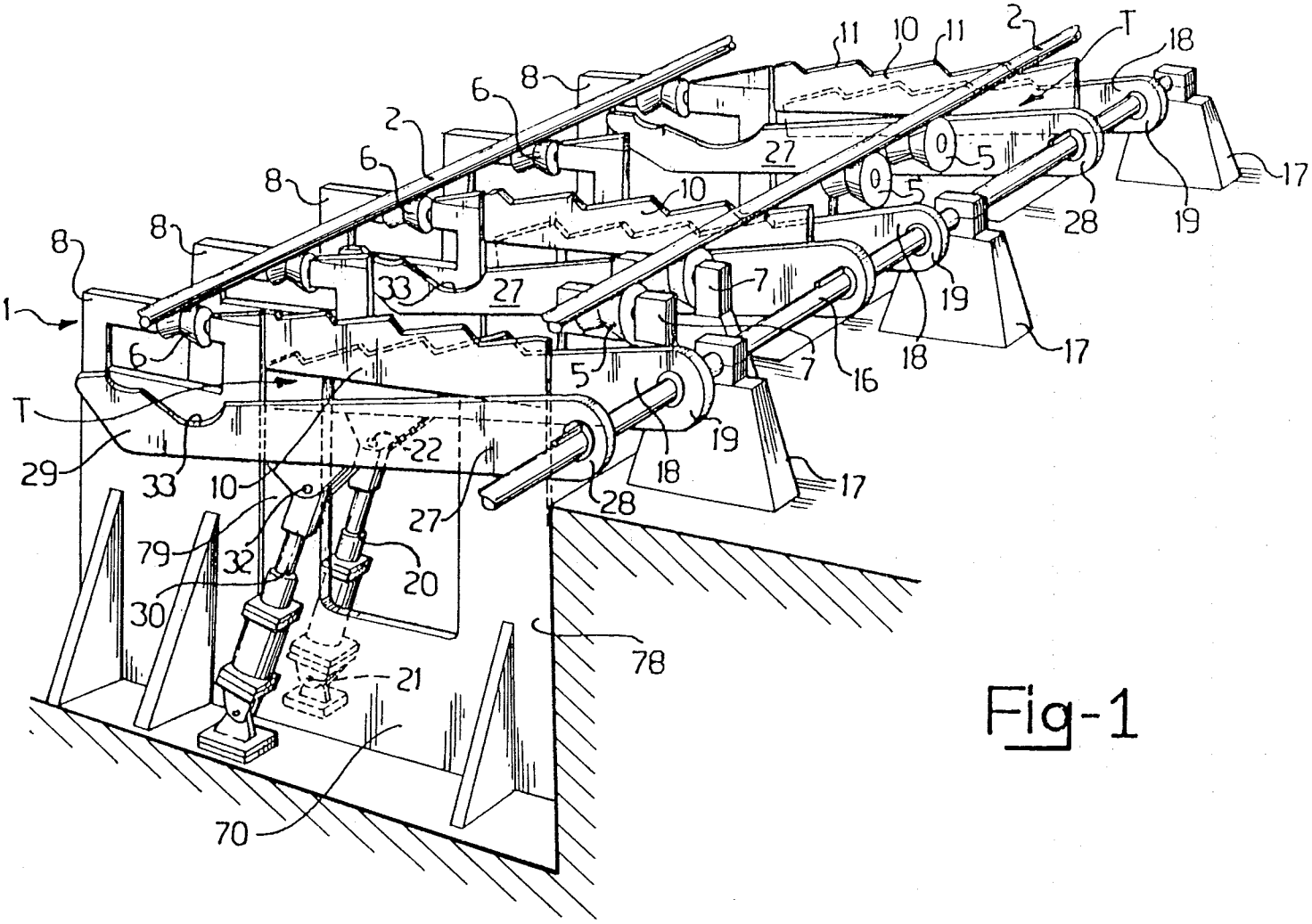
FIG. 1 is a schematic perspective view of apparatus for the lateral transfer of mandrels in a tube rolling mill.

With reference to the drawings, apparatus according to the invention for the lateral transfer of mandrels 2 in a tube rolling mill is generally indicated 1.

More particularly, the apparatus 1 is illustrated in the case of transfer of mandrels 2 from a lube conveyor 3 to an adjacent parallel line 4 for the pre-insertion of the mandrels 2 in respective axially pierced intermediate forgings (not shown) to be conveyed to the rolling mill.

The lube conveyor and the pre-insertion line 3, 4 are of the type with rollers, schematically indicated 5 and 6 respectively mounted on suitable support 7, 8 only shown schematically since they are entirely conventional. According to a preferred but non-limiting embodiment, the rollers 5 of the lube conveyor are larger than the rollers 6 of the pre-insertion line.

The apparatus 1 includes three transfer devices T which are identical and mutually spaced-apart in a direction parallel to the axis of the mandrels 2. Each of the devices T comprises a base structure 70 located between the conveyor 3 and the line 4 and having two pillars 78, 79 extending vertically close to the lube conveyor 3 and the pre-insertion line 4. A horizontal arm 10 is fixed to the pillers 78, 79 and extends between the conveyor 3 and the line 4 perpendicular thereto.

Figure 2:
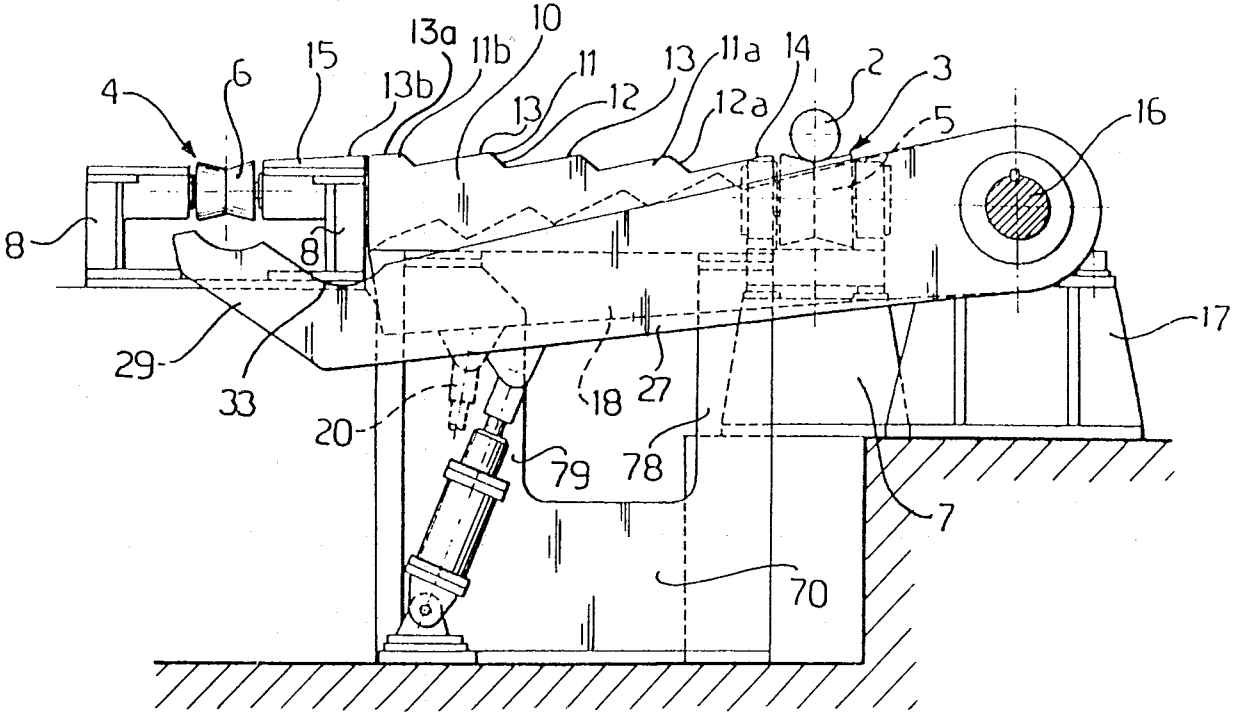
FIG. 2 is a view on an enlarged scale of a transfer device of the apparatus of FIG. 1.

The arm 10 has an upper saw-tooth profile, generally indicated 11 (FIG. 2), the front and back of each tooth whereof are indicated 12 and 13 respectively. The teeth 11 have their respective fronts 12 facing the lube conveyor 3.

The front 12*a* of the first tooth 11*a* of the fixed arm 10 is preceded by a back 14 extending to a level above the rollers 5 of the lube conveyor 3 and having its free end close to the said conveyor.

The back 13*a* of the last tooth 11*b* descends towards the pre-insertion line 4. It should be noted that, in a preferred embodiment, the back 13*b* is constituted by an inclined plane formed by a plate 15 fixed to the support 8 of the pre-insertion line 4 laterally of the rollers 6 thereof.

A horizontal shaft 16 parallel to the lube conveyor 3 and the pre-insertion line 4 is supported by supports 17 externally of and substantially at the same level as the lube conveyor 3.

An arm 18 extending between the lube conveyor 3 and the pre-insertion line 4 has one end 19 rotatably mounted on the shaft 16 and is supported and put into motion, in the manner which will be described below, by a hydraulic cylinder 20 pivoted at 21 to the base structure 70 and at 22 to the arm 18 under consideration, about horizontal pivot axes parallel to the axis of the shaft 16. In the following description and in the subsequent claims, this arm 18 will be identified by the term: first movable arm.

The first movable arm 18 has an upper saw-tooth profile, generally indicated 23, the front and back of each tooth whereof are indicated 24 and 25 respectively.

The saw teeth 23 of the first movable arm 18 are identical to those 11 of the fixed arm 10 and are oriented in the same direction but staggered relative thereto towards the lube conveyor 3.

The front 24*a* of the first tooth 23*a* is preceded by a back 26 extending across the lube conveyor 3 outside which it is connected to the end 19 of the first movable arm 18.

The back 25*b* of the last tooth 23*b* descends towards the pre-insertion line 4.

The first movable arm 18 (movable in a vertical plane perpendicular to the conveyor 3 and the line 4 mentioned several times) is angularly movable about the axis of the shaft 16, by the action of the hydraulic cylinder 20, from a lowered position in which the respective teeth 23 have their backs 25 at a level below the backs 13 of the teeth 11 of the fixed arm 10 to a raised position in which the backs 25 are at a level above the corresponding backs 13.

A second arm indicated 27 is movable in a vertical plane perpendicular to the lube conveyor 3 and the pre-insertion line 4 between which the arm 27 extends in a position symmetrical with that of the first movable arm 18 relative to the fixed arm 10.

The second movable arm 27 has one end 28 coaxially mounted on the shaft 16 and its other end 29 extending across the pre-insertion line 4. The second movable arm 27 is supported and moved, in the manner which will be described below, by a hydraulic cylinder 30 pivoted at 31 on the base structure 70 and at 32 to the movable arm 27 under consideration, about horizontal pivot axes parallel to the axis of the shaft 16.

The second movable arm 27 has an upper straight profile, except in the portion corresponding to the end 29 where the arm 27 has an upper notch 33 for receiving a mandrel, as will become more apparent from the description which follows.

The second movable arm 27 is angularly movable, by means of the hydraulic cylinder 30, about the axis of the shaft 16 from a lowered position in which the upper straight profile thereof is entirely beneath the saw teeth 11 of the fixed arm 10 to a raised position in which the said straight profile is entirely above the teeth 11. In this raised position, the upper straight profile of the second movable arm 27 is inclined downwardly and towards the pre-insertion line 4, while the notch 33 in the end 29 of the arm substantially overlies the inclined plane 13*b* formed by the plate 15 of the pre-insertion line 4.

It should be noted that the mandrels under consideration are straight rod-shaped elements having a length generally between 18 and 23 meters. Hence, it is necessary to use several transfer devices of this invention to move them laterally, as will be described below. In this case, it is an advantage to use a single shaft 16 and the second movable arms 27 of the apparatus are keyed thereto while being movable by respective hydraulic cylinders 30. This ensures the simultaneous raising in unison of all the movable arms 27 and hence the direct transfer of the mandrels from the lube conveyor to the pre-insertion line.

To advantage, the first movable arms 18 of the devices T of the invention are also fixed together, for example by one or more longitudinal members, although each is driven by a respective hydraulic cylinder.

The operation of the apparatus described above is as follows.

In an initial condition, the movable arms 10 and 27 are in their respective lowered positions and a mandrel 2 is present on the rollers 5 of the lube conveyor 3 ready to be used in a rolling cycle.

In the case of regular operation of the rolling mill, the mandrel 2 must be transferred, when required, from the lube conveyor 3 directly to the pre-insertion line 4.

Figure 3:
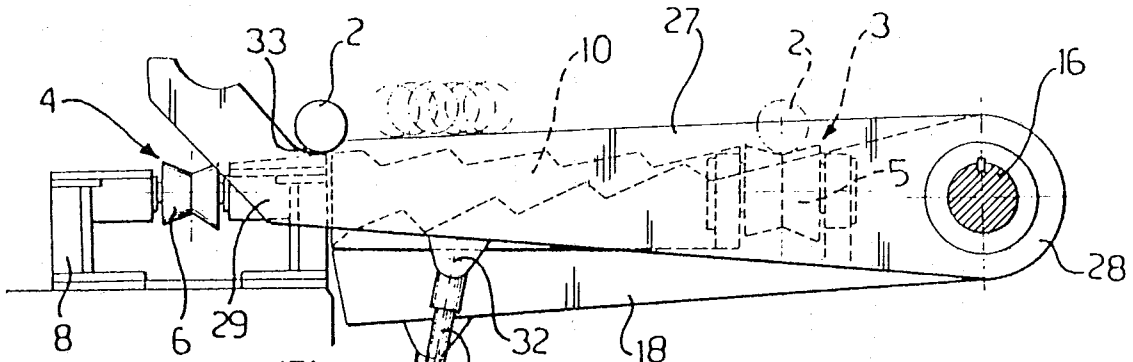
FIGS. 3 and 4 show the device of FIG. 2 in the case of direct transfer of the mandrels from the lube conveyor to the pre-insertion line.

For this purpose (FIGS. 2 and 3) it suffices to move the second movable arm 27 into the raised position. In fact, this being done, the mandrel 2 under consideration, raised from the rollers 5 of the lube conveyor 3, rollers along the straight inclined profile of the arm 27 up to the notch 33 where it is received and held.

Figure 4:
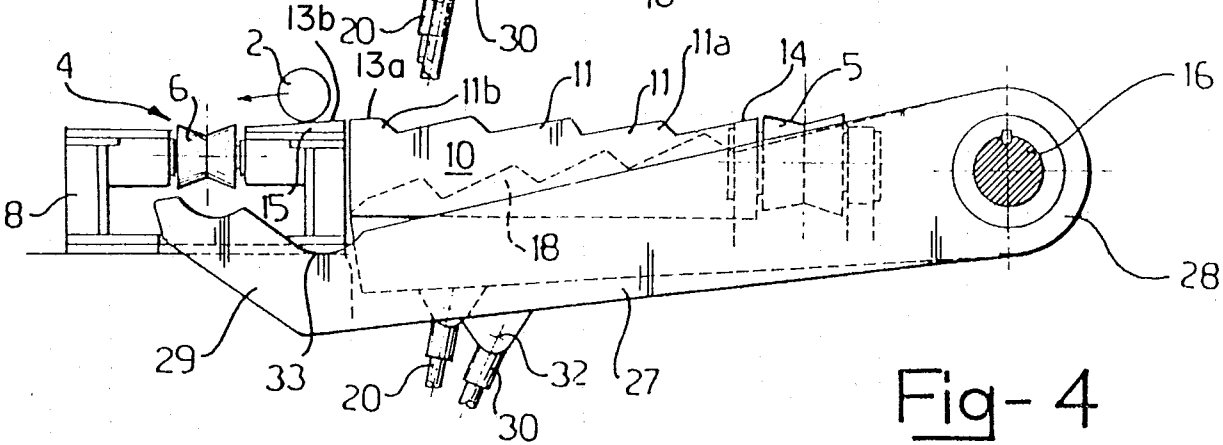

During the subsequent movement of the second movable arm into the lowered position (FIG. 4), the mandrel 2 encounters the inclined plane 13*b* by which it is retained. Immediately the notch 33 is completely beneath the inclined plane, the mandrel 2 rolls thereon up to the rollers 6 of the pre-insertion line 4.

In the meantime, the lube conveyor 3 is made available to receive a further mandrel 2.

Figure 5:
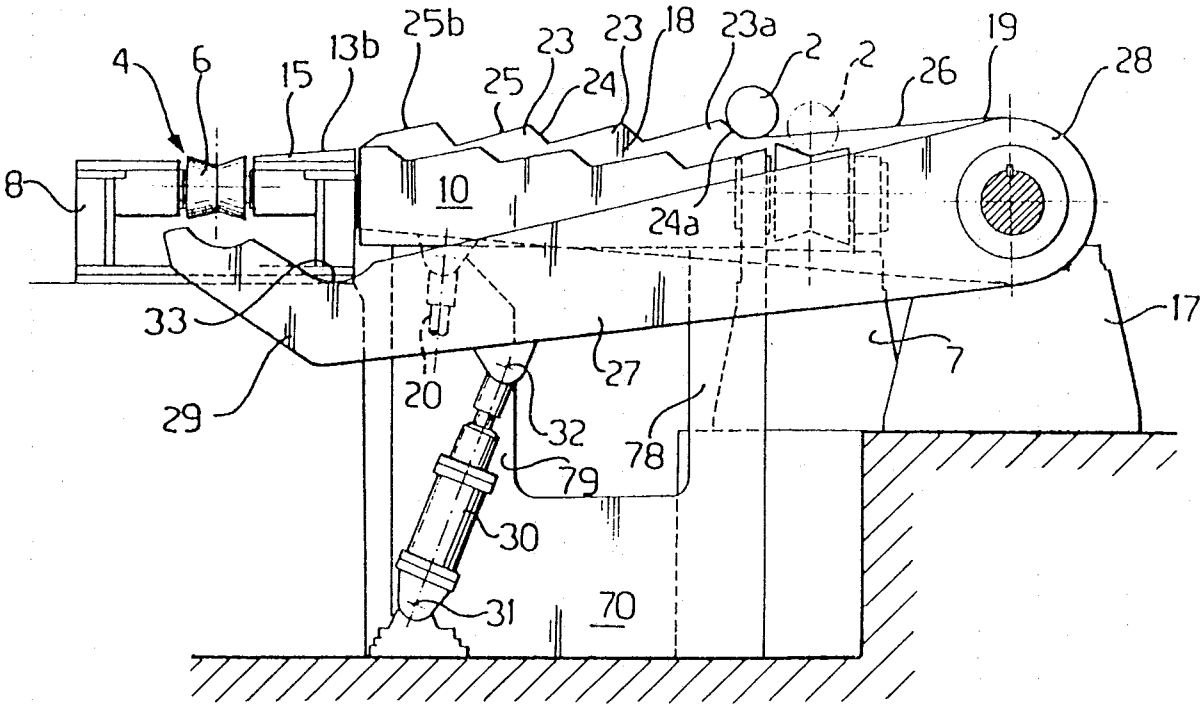
FIGS. 5, 6 and 7 show the device of FIG. 2 in the case of transfer with "storage" of the mandrels between the lube conveyor and the pre-insertion line.

In the event of accidental stoppage of the rolling mill, the first movable arm 18 is moved by the hydraulic cylinder 20 into the raised position (FIG. 5). During this movement, the back 26 of the arms causes the raising of the mandrel 2 from the rollers 5 of the lube conveyor 3 and simultaneously the rolling of the mandrel 2 towards and against the front 24*a* of the first tooth 23*a*. In the raised position of the first movable arm 18, the mandrel 2 is retained by the first tooth 23*a*.

At this point, the first movable arm 18 is returned to the lowered position. During this movement, the mandrel 2 encounters the back 14 of the fixed arm 10 by which it is retained and on which it starts to roll towards the first tooth 11*a* of the arm, as the movable arm 18 is lowered. When the movable arm 18 is in its lowered position, the mandrel 2 is retained by the first tooth 11*a* of the fixed arm 10 and the lube conveyor 3 is available to receive a new mandrel, for example a mandrel indicated 2*a* in FIG. 6.

Figures 6, 7:
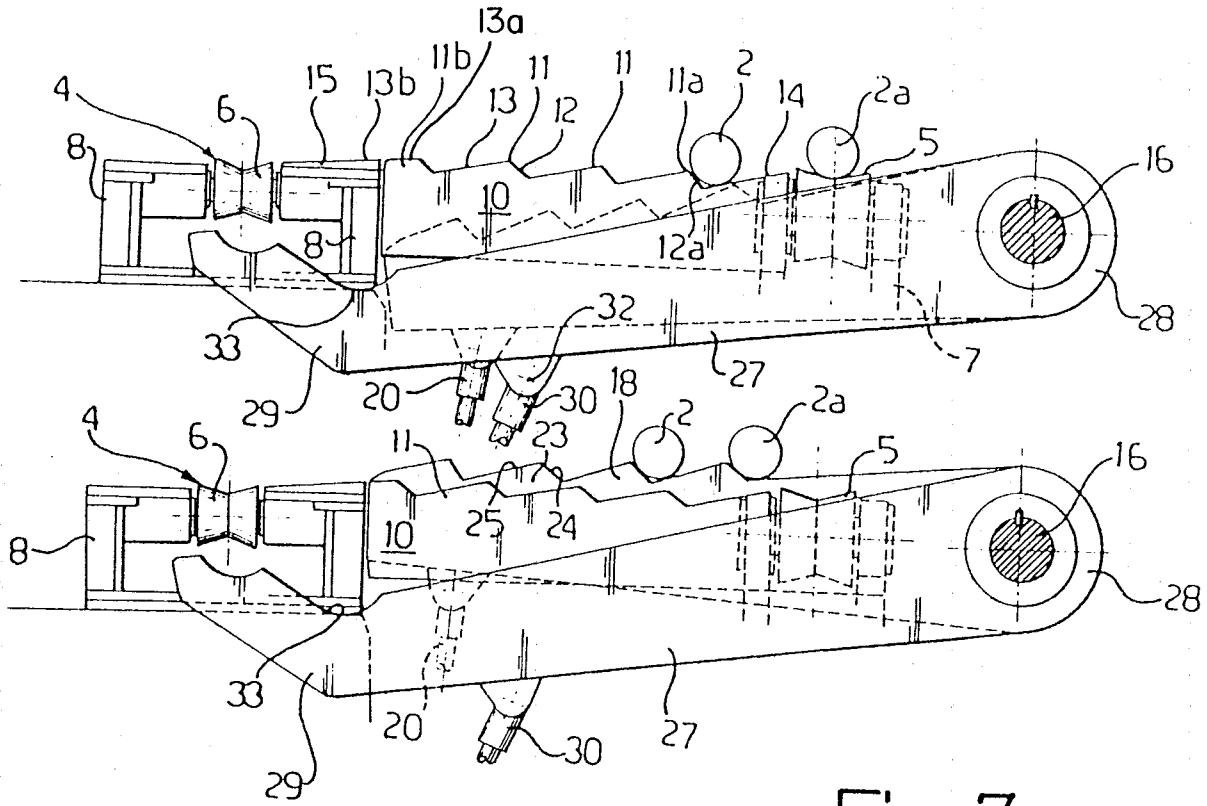

While the rolling mill remains stopped, the operations described above are repeated so that the mandrel 2 is moved against the tooth 11 of the fixed arm 10 behind, the first tooth 11*a* considered above, and the mandrel 2*a* is brought against this tooth 11*a* (FIG. 7). The lube conveyor 3 is then available to receive a third mandrel.

Since the fixed arm 10 and the first movable arm 18 are formed with a number of teeth at least equal to the number of mandrels involved in the so-called "mandrel rotation" of a tube rolling mill, clearly the apparatus of the invention is able to receive and park all the said mandrels between the lube conveyor 3 and the pre-insertion line 4. Consequently, in the event of accidental stoppage of the rolling mill, it is possible for all the mandrels to complete all the operations provided for in the "mandrel rotation", overcoming all of the disadvantages of the prior art.

It should be noted that the mandrels under consideration are straight rod-shaped elements having a length generally between 18 and 23 meters. Hence, it is necessary to use several pieces of apparatus of the invention for their lateral movement, as described above. In this case, there is used to advantage a single shaft 16 and the second movable arms 27 of the apparatus are keyed thereto while being moved by respective hydraulic cylinders 20. This ensures the simultaneous raising in unison of all the movable arms 27 and hence the direct transfer of the mandrels from the lube conveyor to the pre-insertion line.

To advantage, the first movable arms 18 of the apparatus of the invention are also fixed together for example by one or more longitudinal members, each being, driven, however, by a respective hydraulic cylinder.

I claim:

1. Appparatus for the lateral transfer of mandrels in a tube rolling mill, particularly for the transfer of mandrels from a lube conveyor to an adjacent, parallel pre-insertion line, further including at least two transfer devices, characterized in that each of the transfer devices comprises:

fixed arm (10) extending transversely between the lube conveyor (3) and the pre-insertion line (4) and having an upper substantially saw-tooth profile (11) with the front (12) facing the lube conveyor (3), a first tooth (11*a*) having its front (12*a*) preceded by a back (14) extending close to the lube conveyor (3) at a level above the upper profile thereof, the final tooth (11*b*) having its back (13*b*) descending towards the pre-insertion line (4) and terminating near it, a first arm (18) movable in a vertical plane perpendicular to the lube conveyor (3) and the pre-insertion line (4), which arm (18) extends between the conveyor (3) and the line (4) and has one end outside the lube conveyor (3), the first movable arm (18) having an upper saw-tooth profile (23) substantially the same as that of the fixed arm (10) but staggered relative thereto towards the lube conveyor (3), a first tooth (23*a*) having a front (24*a*) preceded by a back (26) extending across the lube conveyor (3), drive means (20) connected to said first movable arm for moving said first movable arm (18) between first and second positions in which the respective teeth (23) have their backs (24) at a lower level and an upper level respectively compared to the backs (13) of the teeth (11) of the fixed arm (10), a second arm (27) movable in a vertical plane perpendicular to the lube conveyor (3) and the pre-insertion line (4), which arm (27) extends between the conveyor (3) and the line (4) and has an upper straight profile and one end (28) outside the lube conveyor (3), drive means (30) connected to said second movable arm for moving said second movable arm (27) between first and second positions in which the upper straight profile thereof is respectively entirely beneath and above the teeth (11) of the fixed arm (10), in both positions the straight profile of the second movable arm (27) being inclined downwardly and towards the pre-insertion line (4).

2. Apparatus according to claim 1, characterised in that it includes a horizontal shaft (16) rotatably supported outside and parallel to the lube conveyor (13), on which shaft (16) there are coaxially mounted the ends (28) of the second movable arms (27) of the transfer devices (T), the drive means (30) displacing the second movable arms (27) angularly about the axis of the shaft (16) from the first to the second position and vice versa.

3. Apparatus according to claim 2, characterised in that the ends (28) of the second movable arms (27) are keyed to the horizontal shaft (16).

4. Apparatus according to claim 3, characterised in that the ends (19) of the first movable arms (18) of the transfer devices (T) are rotatably and coaxially mounted on the horizontal shaft (16).

* * * * *